US006137071A

United States Patent [19]

Yeh et al.

[11] Patent Number: 6,137,071

[45] Date of Patent: Oct. 24, 2000

[54] MULTIPLE-WIDTH KEYSWITCH CAPABLE OF INHIBITING NOISE THEREOF INDUCED DURING OPERATION

[75] Inventors: Chi-Pin Yeh; Mao-Sung Huang, both of Taoyuan, Taiwan

[73] Assignee: Acer Peripherals Inc., Taoyuan, Taiwan

[21] Appl. No.: 09/378,681

[22] Filed: Aug. 20, 1999

[51] Int. Cl.[7] ..... H01H 13/70

[52] U.S. Cl. ..... 200/344; 200/341

[58] Field of Search ..... 200/341–344, 200/301, 512–517

[56] References Cited

U.S. PATENT DOCUMENTS

| | | | |
|---|---|---|---|
| 4,582,967 | 4/1986 | Brumit et al. | 200/5 A |
| 4,902,862 | 2/1990 | Oelsch et al. . | |
| 5,278,371 | 1/1994 | Watanabe et al. . | |
| 5,504,283 | 4/1996 | Kako et al. . | |
| 5,823,325 | 10/1998 | Lin . | |
| 5,950,810 | 9/1999 | Pan et al. | 200/344 |
| 6,004,051 | 12/1999 | Hu | 400/491.2 |

*Primary Examiner*—Michael L. Gellner
*Assistant Examiner*—Nhung Nguyen
*Attorney, Agent, or Firm*—Majestic, Parsons, Siebert & Hsue P.C.

[57] ABSTRACT

An improved multiple-width keyswitch capable of inhibiting noise thereof induced during operation is provided. The multiple-width keyswitch includes a keycap and a substrate. During operation, the keycap moves vertically relative to the substrate. The keycap defines a lower surface which is provided with a plurality of bosses. The substrate is provided with a plurality of openings. Each of the plurality of openings is disposed under one corresponding boss and covered with a deformable layer. When the keycap moves downward to turn on the keyswitch, each of the bosses first impacts the deformable layer into the corresponding opening such that the impact energy of the keycap is absorbed by the deformable layer. Thereby the noise induced by the impact of the keycap can be effectively inhibited. Embodiments and equivalent modifications of the invention are described in detail in the specification.

14 Claims, 8 Drawing Sheets

MULTIPLE-WIDTH KEYSWITCH CAPABLE OF INHIBITING NOISE THEREOF INDUCED DURING OPERATION

FIELD OF INVENTION

The present invention relates to a multiple-width keyswitch, and more in particular, to an improved multiple-width keyswitch with capability of inhibiting noise thereof induced during operation.

BACKGROUND OF INVENTION

The keyswitch with a scissors-type supporting mechanism has been widely utilized in a computer keyboard due to its feature of compactness.

Typically, a keyboard consists of a plurality of keys most of which are formed in square shape. However, there are some keys which have a longer dimension, such as the "ENTER", "SPACE BAR", and "SHIFT" keys. These special keys are usually referred to as the multiple-width key.

Taking the multiple-width key which employs the scissors-type keyswitch as an example, it generally includes a keycap, an internal arm, an external arm, a resilient dome, a membrane switch, and a substrate. The internal and external arms are pivotally assembled to each other, and thereby the scissors-type supporting mechanism is constituted. The substrate includes a main planar surface on which a pair of receiving grooves and a bearing portion are respectively and integrally formed. The keycap has a lower surface with a pair of first retaining portions which are spaced from each other. A pair of second retaining portions, which are spaced from each other, are also formed on the lower surface of the keycap. The internal arm is provided with a first shaft at a first end which is pivotally disposed between the pair of the first retaining portions of the keycap. The internal arm is further provided with a second shaft at a second end which is slidably and rotatably received within a bearing portion of the substrate. The external arm is provided with a projected boss which is slidably and rotatably received within a corresponding receiving groove of the substrate.

The supporting mechanism is provided to support the keycap to move vertically relative to the substrate during the operation of the multiple-width keyswitch. The resilient dome, responsive to the movement of the keycap, is deformed to contact the membrane switch to turn on the keyswitch.

However, during the operation of the multiple-width keyswitch, nose induced by impact which is generated between the keycap and the substrate can not be avoided.

Accordingly, this present invention is to provide an improved multiple-width keyswitch with capability of inhibiting noise thereof induced during operation.

SUMMARY OF INVENTION

It is the objective of the invention to provide a multiple-width keyswitch which substantially inhibits the operation noise due to the impact generated between its keycap and substrate.

The improved keyswitch includes a keycap, a substrate, a supporting mechanism, a resilient dome and a membrane switch.

The keycap defines an upper surface and a lower surface which is provided with a connecting portion. The substrate has a connecting portion. The supporting mechanism has an upper end pivotally engaged to the connecting portion of the keycap and has a lower end pivotally engaged with the connecting portion of the substrate such that the keycap can be supported by the supporting mechanism to move vertically relative to the substrate.

The resilient dome is deformed toward the membrane switch in response to the movement of the keycap. When the resilient dome contacts the membrane switch, the keyswitch is turned on.

According to the invention, there are a plurality of bosses provided on the lower surface of the keycap. Alternatively, the keycap has an edge defining a bottom surface. According to the invention, there are a plurality of projecting portions provided on the bottom of the edge.

According to the invention, there are a plurality of openings provided on the substrate, each of which is covered with a deformable layer. Alternatively, according to the invention, there are a plurality of convex portions provided on the substrate.

Each of the plurality of the openings or convex portions is disposed under a corresponding boss or projecting portion. Consequently, when the keycap moves downward, each of the bosses or projecting portions first impacts against the deformable layer or the corresponding convex portion such that the impact force of the keycap is absorbed by the deformable layer or the convex portions. Therefore, the noise induced by the impact of the keycap can be effectively inhibited.

The advantage and spirit of the invention may be understood by the following recitations together with the appended drawings.

BRIEF DESCRIPTION OF THE APPENDED DRAWINGS

DETAILED DESCRIPTION OF THE INVENTION

This invention is to provide an improved multiple-width keyswitch capable of effectively inhibiting the operation noise due to the impact of its keycap. Several preferred embodiments according to the invention are disclosed as follows.

Figure 1A:
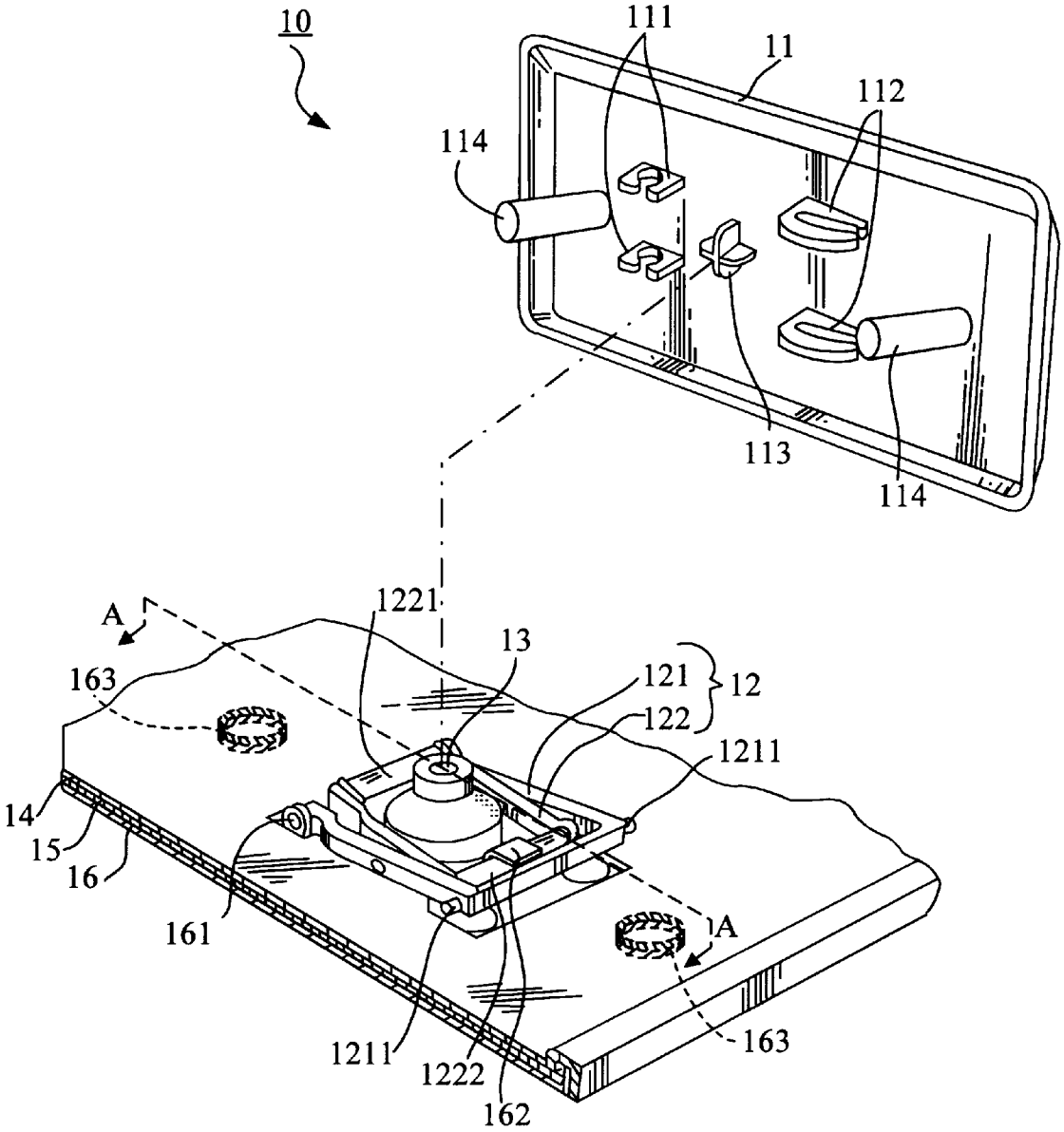
FIG. 1A is an exploded perspective view of a multiple-width keyswitch 10 according to a first embodiment of the invention.
Figure 1B:
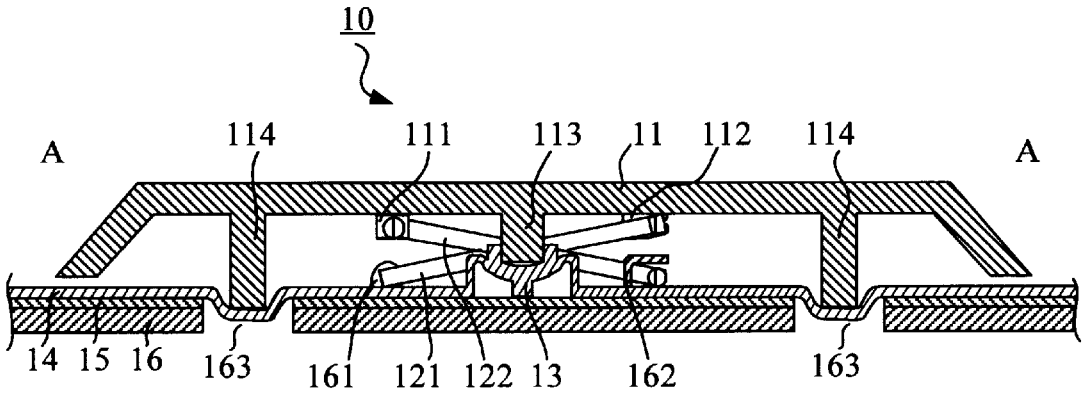
FIG. 1B is cross sectional view of the multiple-width keyswitch 10 shown in FIG. 1A after assembly along A—A line.

Referring to FIGS. 1A and 1B, a first embodiment of the invention is described in detail. As shown in an exploded perspective view in FIG. 1A, a multiple-width keyswitch 10, according to the first embodiment of the invention, includes a keycap 11, a supporting mechanism 12, a resilient dome 13, a deformable sheet membrane 14, a membrane switch layer 15 and a substrate 16. The supporting mechanism 12 is constituted by an external arm 121 and an internal arm 122.

The keycap 11 defines a lower surface thereof. The lower surface is provided with a pair of first retaining lugs 111, a pair of second retaining lugs 112, an engagement portion 113 and at least one boss 114. For simplicity, a pair of bosses 114 are illustratively shown in FIG. 1A. The first and second retaining lugs 111 and 112 together define the connecting portion of the keycap 11 for engaging with the internal arm 122 and external arm 121, respectively.

A pair of receiving lugs 161 and a bearing portion 162 which exhibits an inverted L-shape are integrally formed with the substrate 16. The receiving lugs 161 and the bearing portion 162 together define a connecting portion of the substrate 16 for engaging with the external arm 121 and internal arm 122. The resilient dome 13 is integrally formed with the deformable sheet membrane 14.

The external arm 121 and the internal arm 122 are pivotally assembled together such that a scissors-type supporting mechanism 12 for the keyswitch 10 is formed. One upper end of the supporting mechanism 12 is inserted within the connecting portion of the keycap 11 and one lower end of the supporting mechanism 12 is inserted within the connecting portion of the substrate 16. By this arrangement, the keycap 11 moves vertically toward or away from the substrate 16 due to action of the supporting mechanism 12 constituted by the external and internal arms (121 and 122). The internal arm 122 is provided with a first shaft 1221 at a first end which is pivotally attached to the first retaining lugs 111. The internal arm 122 is further provided with a second shaft 1222 at a second end which is slidably and rotatably received within the bearing portion 162 of the substrate 16. The external arm 121 is provided with a pair of bosses at a first end which are respectively slidably and rotatably received within one of the corresponding receiving lugs 161 of the substrate 16. The external arm 121 is provided with a pair of hinge pins 1211 at a second end which are respectively slidably and rotatably disposed within the second retaining lugs 112 of the keycap 11.

When assembled, the engagement portion 113 of the keycap 11 is inserted and retained within the corresponding hole of the resilient dome 13. When the keycap 11 is depressed downward to deform the resilient dome 13 to contact the membrane switch layer 15, the keyswitch 10 is turned on. When the keycap 11 bounces back by the elastic force of the deformed dome 13, the keyswitch 10 is turned off.

In order to solve the drawback encountered by the conventional approach, at least one opening 163 is formed on the substrate 16. The opening 163 is disposed under a corresponding boss 114 and covered with a deformable layer. Also for simplicity, only a pair of openings 163 are illustratively shown in FIG. 1A.

Referring to FIG. 1B, a cross sectional view of the keyswitch 10 after assembled along A—A line in FIG. 1A is shown. It is clear that when the keycap 11 moves downward, each of the bosses 114 first impacts against the deformable layer into the corresponding opening 163 such that the impact energy of the keycap 11 is absorbed by the deformable layer. As a result, the noise induced by the impact of the keycap 11 can be effectively inhibited.

In a preferred embodiment, the deformable layer is constituted by the sheet membrane 14, as shown in FIG. 1B. In another preferred embodiment, the deformable layer is constituted by the membrane switch layer 15. In another preferred embodiment, the deformable layer is constituted by the sheet membrane 14 and the membrane switch layer 15.

Figure 2A:
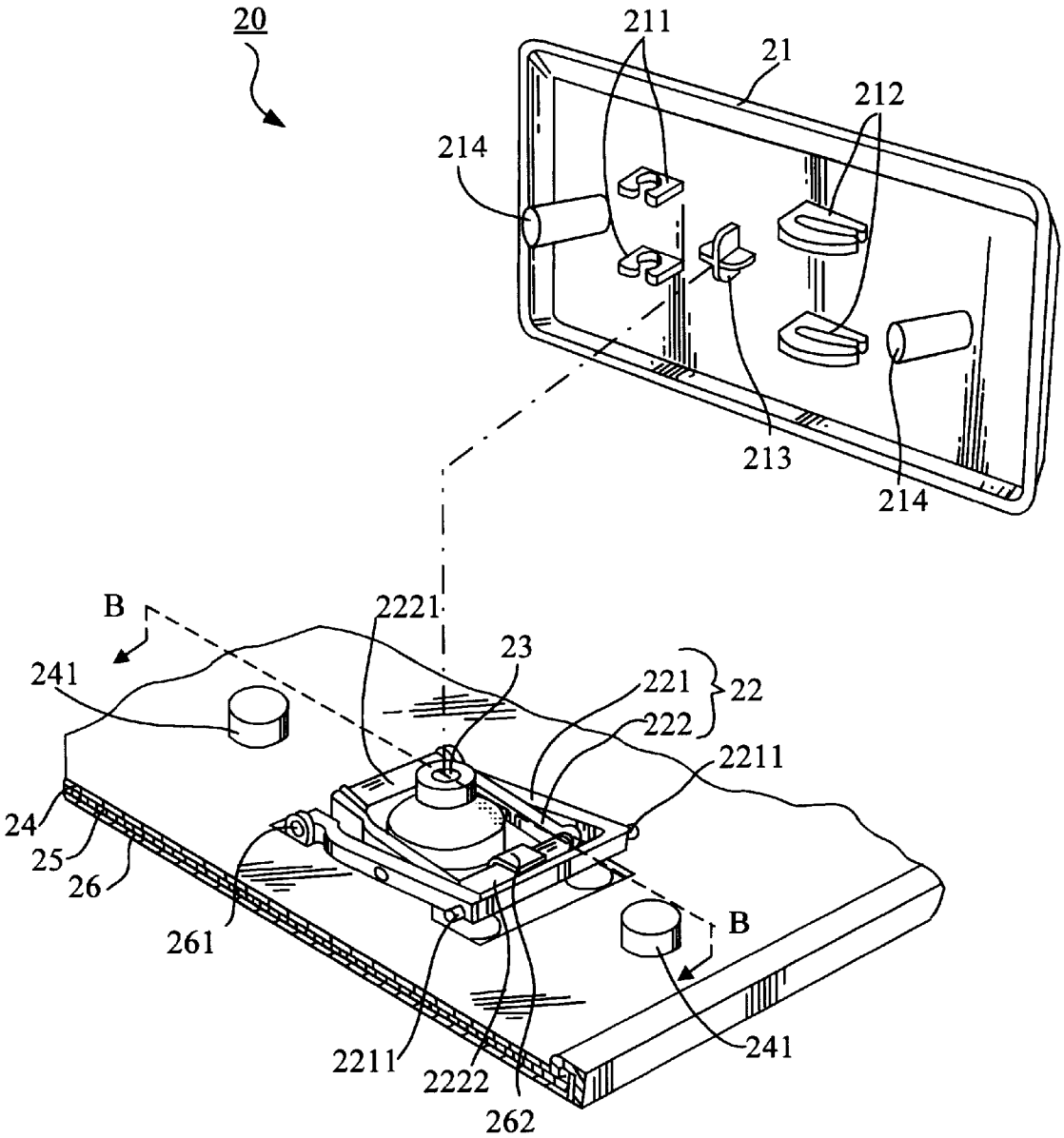
FIG. 2A is an exploded perspective view of a multiple-width keyswitch 20 according to a second embodiment of the invention.
Figure 2B:
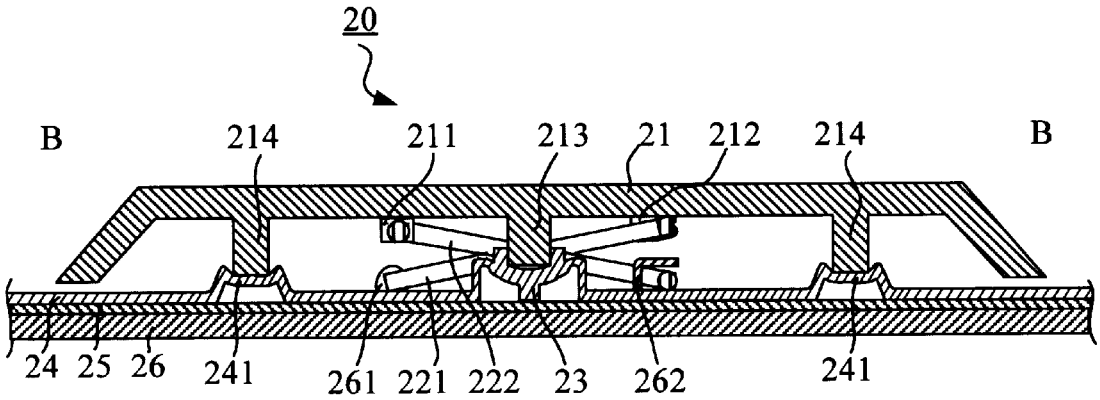
FIG. 2B is a cross sectional view of the multiple-width keyswitch 20 shown in FIG. 2A after assembly along B—B line.

Referring to FIGS. 2A and 2B, a second embodiment of the invention is described in detail. As shown in an exploded perspective view in FIG. 2A, a multiple-width keyswitch 20, according to the second embodiment of the invention, includes a keycap 21, a supporting mechanism 22, a resilient dome 23, a deformable sheet membrane 24, a membrane switch layer 25 and a substrate 26. The supporting mechanism 22 is constituted by an external arm 221 and an internal arm 222.

The keycap 21 defines a lower surface thereof. The lower surface is provided with a pair of first retaining lugs 211, a pair of second retaining lugs 212, an engagement portion 213 and at least one boss 214. For simplicity, only a pair of bosses 214 are illustratively shown in FIG. 2A. The first and second retaining lugs 211 and 212 together define the connecting portion of the keycap 21 for engaging with the internal arm 222 and external arm 221, respectively.

A pair of receiving lugs 261 and a bearing portion 262 which exhibits an inverted L-shape are integrally formed with the substrate 26. The receiving lugs 261 and the bearing portion 262 together define a connecting portion of the substrate 26 for engaging with the external arm 221 and internal arm 222, respectively. The resilient dome 23 is integrally formed with the deformable sheet membrane 24.

The element in the second embodiment having the same terminology as that in the first embodiment performs the same function as recited with regard to the first embodiment. Hereinafter, the arrangement and function of the elements, mentioned in the first embodiment, are not described any more.

Differing from the first embodiment, there is at least one convex portion 241 provided on the substrate 26. The convex portions 241 is disposed under a corresponding boss 214. Also for simplicity, only a pair of convex portions 241 are illustratively shown in FIG. 2A.

Referring to FIG. 2B, a cross sectional view of the keyswitch 20 after assembled along B—B line in FIG. 2A is shown. The configuration of each of the convex portions 241 may be together with the sheet membrane 24 to constitute an air bag. when the keycap 21 moves downward, each of the bosses 214 first impacts against the corresponding convex portion 241 such that the impact energy of the keycap 21 is absorbed by the deformed convex portions 241. Consequently, the noise induced by the impact of the keycap 21 can be effectively inhibited.

Figure 3A:
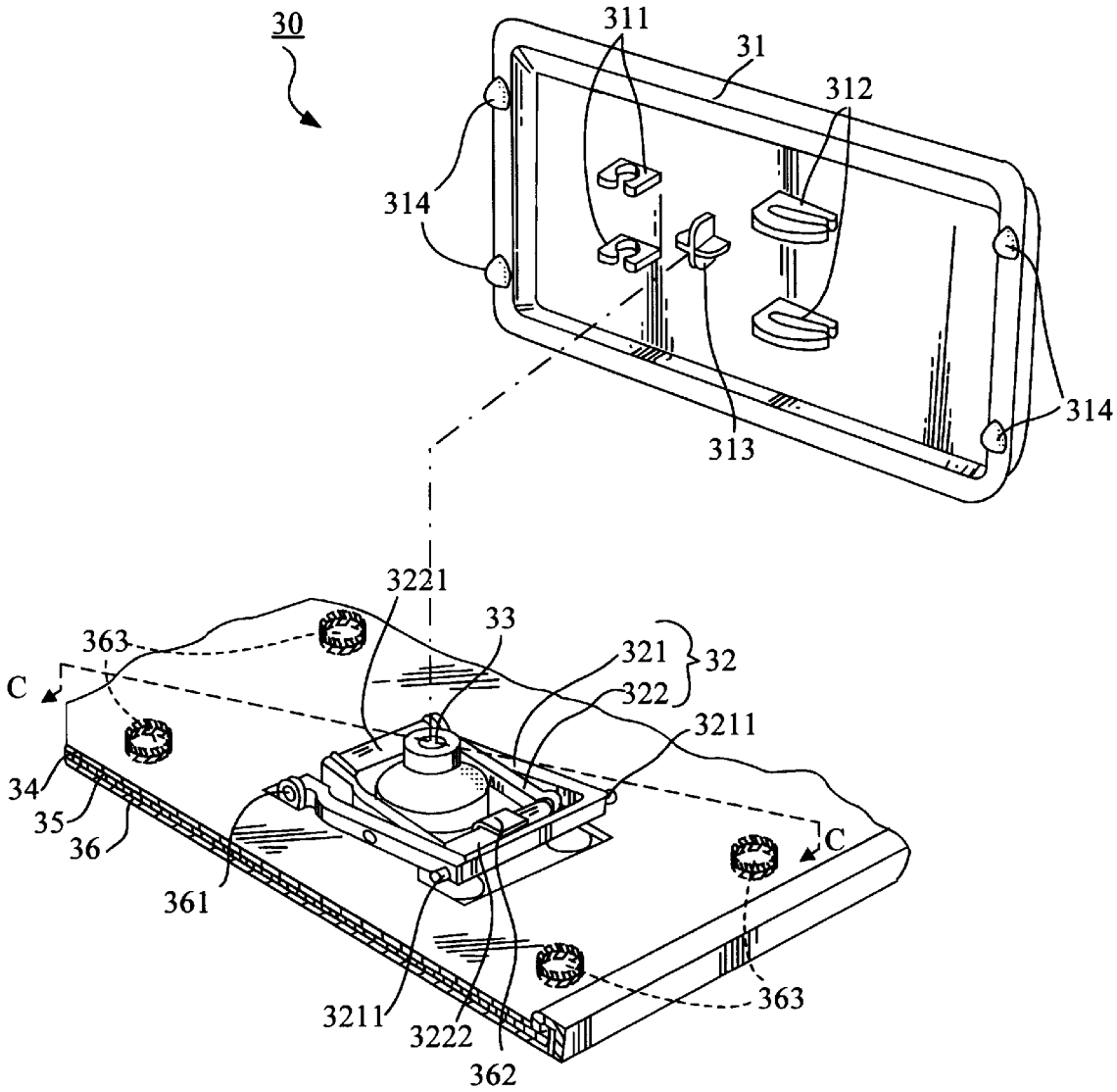
FIG. 3A is an exploded perspective view of a multiple-width keyswitch 30 according to a third embodiment of the invention.
Figure 3B:
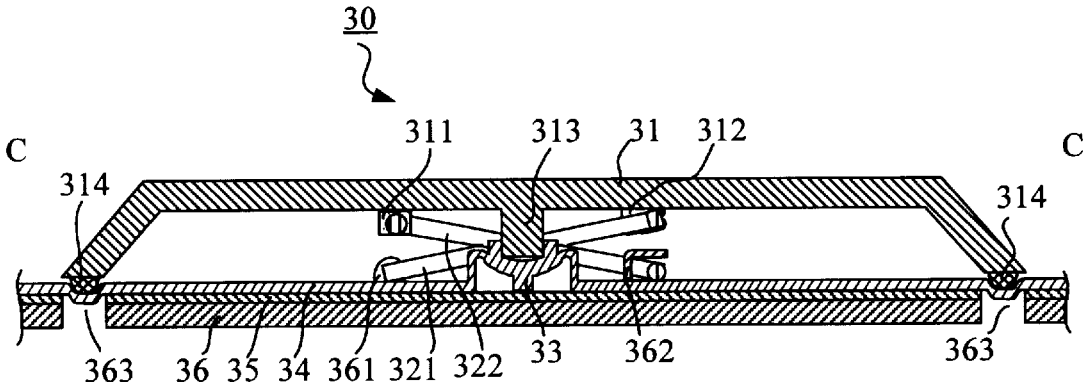
FIG. 3B is a cross sectional view of the multiple-width keyswitch 30 shown in FIG. 3A after assembly along C—C line.

Referring to FIGS. 3A and 3B, a third embodiment of the invention is described in detail. As shown in an exploded perspective view in FIG. 3A, a multiple-width keyswitch 30, according to the third embodiment of the invention, includes a keycap 31, a supporting mechanism 32, a resilient dome 33, a deformable sheet membrane 34, a membrane switch layer 35 and a substrate 36. The supporting mechanism 32 is constituted by an external arm 321 and an internal arm 322.

The keycap 31 defines a lower surface thereof. The lower surface is provided with a pair of first retaining lugs 311, a pair of second retaining lugs 312, an engagement portion 313 and at least one boss 314. For simplicity, only a pair of bosses 314 are illustratively shown in FIG. 3A. The first and second retaining lugs 311 and 312 together define the connecting portion of the keycap 31 for engaging with the internal arm 322 and external arm 321, respectively.

A pair of receiving lugs 361 and a bearing portion 362 which exhibits an inverted L-shape are integrally formed with the substrate 36. The receiving lugs 361 and the bearing portion 362 together define a connecting portion of the substrate 36 for engaging wit the external arm 321 and internal arm 322, respectively. The resilient dome 33 is integrally formed with the deformable sheet membrane 34.

Hereafter, only the configuration of the third embodiment for inhibiting the operation noise of the keyswitch 30 is described in detail.

The keycap 31 has an edge defining a bottom surface. It is a characteristic that there is at least one projecting portion 314 provided on the bottom surface of the keycap 31. Moreover, there is at least one opening 363 corresponding to the projecting portion 314 and formed on the substrate 36. For simplicity, only two pairs of projecting portions 314 and two pairs of corresponding openings 363 are illustratively shown in FIG. 3A. Each of the openings 363 is disposed under the corresponding projecting portion 314 and covered with a deformable layer.

Referring to FIG. 3B, a cross sectional view of the keyswitch 30 after assembled along C—C line in FIG. 3A is shown. When the keycap 31 moves downward, each of the projecting portions 314 first impacts against the deformable layer into the corresponding opening 363 such that the impact energy of the keycap 31 is absorbed by the deformable layer. As a result, the noise induced by the impact of the keycap 31 can be effectively inhibited.

In a preferred embodiment, the deformable layer is constituted by the sheet membrane 34, as shown in FIG. 3B. In another preferred embodiment, the deformable layer is constituted by the membrane switch layer 35. In another embodiment, the deformable layer is constituted by the sheet membrane 34 and the membrane switch layer 35.

Figure 4A:
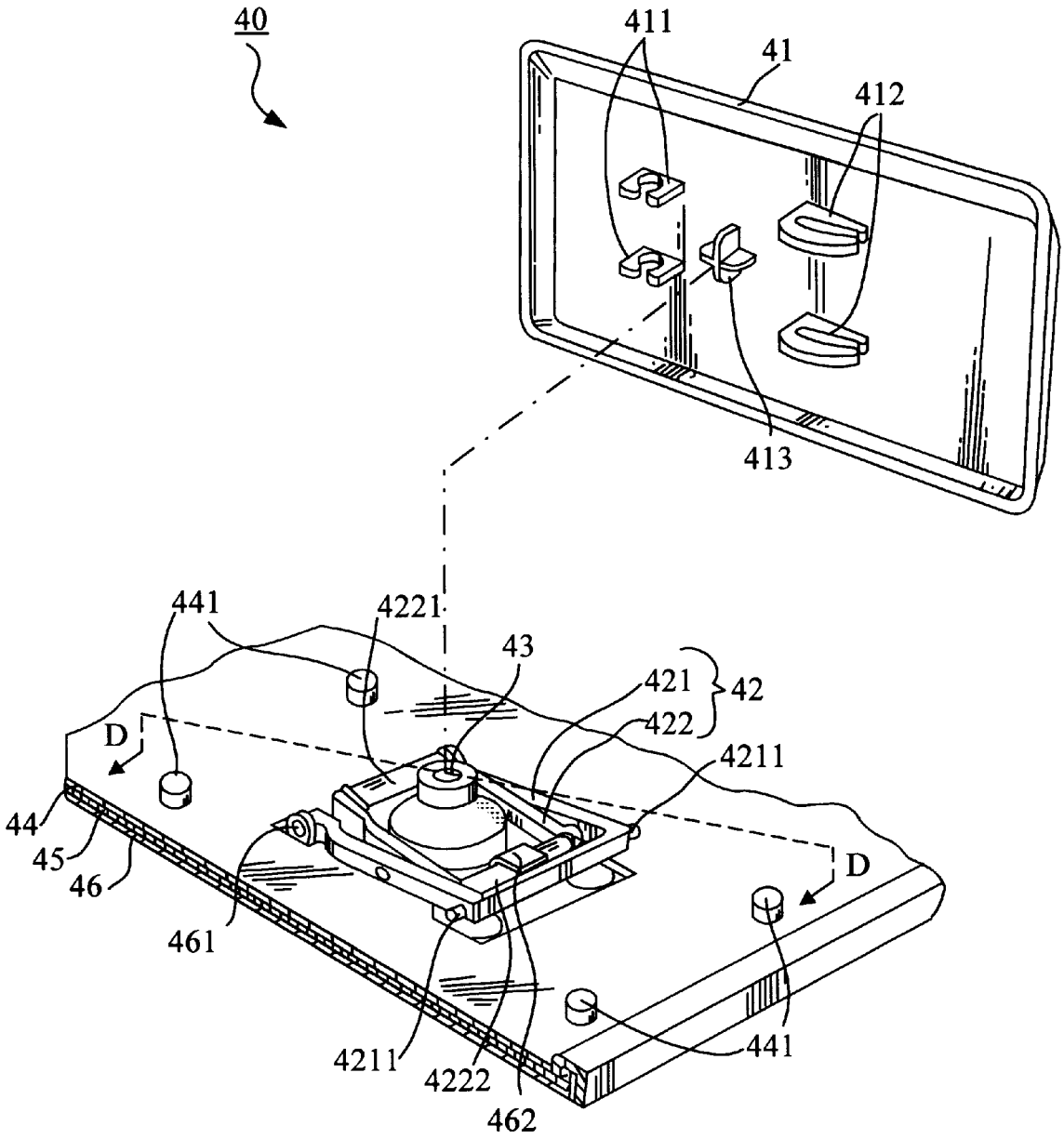
FIG. 4A is an exploded perspective view of the multiple-width keyswitch 40 according to a fourth embodiment of the invention.
Figure 4B:
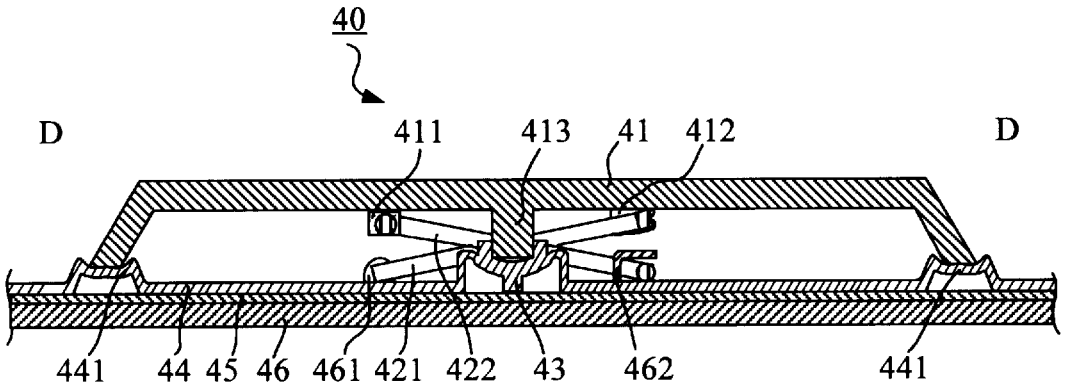
FIG. 4B is a cross sectional view of the multiple-width keyswitch 40 shown in FIG. 4A after assembly along D—D line.

Referring to FIGS. 4A and 4B, a fourth embodiment of the invention is described in detail. As shown in an exploded perspective view in FIG. 4A, a multiple-width keyswitch 40, according to the fourth embodiment of the invention, includes a keycap 41, a supporting mechanism 42, a resilient dome 43, a deformable sheet membrane 44, a membrane switch layer 45 and a substrate 46. The supporting mechanism 42 is constituted by an external arm 421 and an internal arm 422.

The keycap 41 defines a lower surface thereof. The lower surface is provided with a pair of first retaining lugs 411, a pair of second retaining lugs 412, an engagement portion 413 and at least one boss 414. The first and second retaining lugs 411 and 412 together define the connecting portion of the keycap 41 for engaging with the internal arm 422 and external arm 421, respectively.

A pair of receiving lugs 461 and a bearing portion 462 which exhibits an inverted L-shape are integrally formed with the substrate 46. The receiving lugs 461 and the bearing portion 462 together define a connecting portion of the substrate 46 for engaging with the external arm 421 and internal arm 422, respectively. The resilient dome 43 is integrally formed with the deformable sheet membrane 44.

Hereinafter, only the configuration of the fourth embodiment for inhibiting the operation noise of the keyswitch 40 is described in detail.

The keycap 41 has an edge defining a bottom surface. There is at least one convex portion 441 provided on the substrate 46. For simplicity, only two pairs of convex portions 441 are illustratively shown in FIG. 4A. The convex portions 441 are appropriately disposed under the bottom surface of the keycap 41 such that the keycap 41 can be prevented from biasing when it contacts the convex portions 441.

Referring to FIG. 4B, a cross sectional view of the keyswitch 40 after assembled along D—D line in FIG. 4A is shown. The configuration of each of the convex portions 441 may be together with the sheet membrane 44 to constitute an air bag. When the keycap 41 moves downward, the bottom surface of the keycap 41 first impacts against the convex portions 441 such that the impact energy of the keycap 41 is absorbed by the deformed convex portions 441. Consequently, the noise induced by the impact of the keycap 41 can be effectively inhibited.

While specific embodiments of the invention have been illustrated and described, it would be obvious to those who skill in the arts that various equivalent changes or modifications can be made without departing from the spirit and scope of the invention which is defined in the following claims.

What is claimed is:

1. A keyswitch comprising:

a keycap defining a lower surface, the lower surface being provided with at least one boss;

a supporting mechanism;

a switch; and a substrate, said substrate being provided with at least one opening, the opening corresponding to the boss and covered with a deformable layer;

wherein said supporting mechanism supports said keycap to vertically move relative to said substrate, said switch is selectively turned on in response to the movement of said keycap, when said keycap moves downward, the boss first impacts against the deformable layer such that a portion of the deformable layer is deformed into the corresponding opening.

2. The keyswitch of claim 1, wherein said switch comprises:

a membrane switch layer disposed on said substrate; and a resilient dome disposed on said membrane switch layer, said resilient dome, responsive to the movement of said keycap, being deformed to contact said membrane switch layer to turn on said switch.

3. The keyswitch of claim 2, wherein the lower surface of said keycap and the substrate are provided with a connecting portion, respectively, and wherein said supporting mechanism has an upper end engaged to the connecting portion of said keycap and a lower end engaged to the connecting portion of said substrate.

4. The keyswitch of claim 3, wherein said supporting mechanism is constituted by an internal arm and an external arm to form a scissors-type mechanism.

5. The keyswitch of claim 2, wherein the deformable layer is constituted by a deformable sheet membrane, the deformable sheet membrane is integrally formed with the resilient dome.

6. The keyswitch assembly of claim 2, wherein the deformable layer is constituted by the membrane switch layer.

7. The keyswitch assembly of claim 2, wherein the deformable layer is constituted by a deformable sheet membrane and the membrane switch layer, the deformable sheet membrane is integrally formed with the resilient dome.

8. A keyswitch comprising:

a keycap, said keycap having an edge defining a bottom surface, the bottom surface being provided with at least one projecting portion;

a supporting mechanism;

a switch; and a substrate, said substrate being provided with at least one opening, the opening corresponding to the projecting portion and covered with a deformable layer;

wherein said supporting mechanism supports said keycap to vertically move relative to said substrate, said switch is selectively turned on in response to the movement of said keycap, when said keycap moves downward, the projecting portion first impacts against the deformable layer such that a portion of the deformable layer is deformed into the corresponding opening.

9. The keyswitch of claim 8, wherein said switch comprises:

a membrane switch layer disposed on said substrate; and a resilient dome disposed on said membrane switch layer, said resilient dome, responsive to the movement of said keycap, being deformed to contact said membrane switch layer to turn on said switch.

10. The keyswitch of claim 9, wherein said keycap defines a lower surface, the lower surface and the substrate are provided with a connecting portion, respectively, and wherein said supporting mechanism has an upper end engaged to the connecting portion of said keycap and a lower end engaged to the connecting portion of said substrate.

11. The keyswitch of claim 10, wherein said supporting mechanism is constituted by an internal arm and an external arm to form a scissors-type mechanism.

12. The keyswitch of claim 9, wherein the deformable layer is constituted by a deformable sheet membrane, the deformable sheet membrane is integrally formed with the resilient dome.

13. The keyswitch of claim 9, wherein the deformable layer is constituted by the membrane switch layer.

14. The keyswitch of claim 9, wherein the deformable layer is constituted by a deformable sheet membrane and a membrane switch layer, the deformable sheet membrane is integrally formed with the resilient dome.

* * * * *